US010781681B2

(12) United States Patent
Santos

(10) Patent No.: US 10,781,681 B2
(45) Date of Patent: Sep. 22, 2020

(54) AUTOMATED MODEL BASED DRILLING

(71) Applicant: SafeKick Americas LLC, Katy, TX (US)

(72) Inventor: Helio Mauricio Ribeiro dos Santos, Reading (GB)

(73) Assignee: SAFEKICK AMERICAS LLC, Katy, TX (US)

( * ) Notice: Subject to any disclaimer, the term of this patent is extended or adjusted under 35 U.S.C. 154(b) by 317 days.

(21) Appl. No.: 15/898,461

(22) Filed: Feb. 17, 2018

(65) Prior Publication Data

US 2018/0171775 A1 Jun. 21, 2018

Related U.S. Application Data

(63) Continuation of application No. PCT/US2017/057451, filed on Oct. 19, 2017.

(Continued)

(51) Int. Cl.
*E21B 44/00* (2006.01)
*E21B 21/08* (2006.01)

(Continued)

(52) U.S. Cl.
CPC ..... *E21B 44/005* (2013.01); *E21B 21/08* (2013.01); *E21B 41/0092* (2013.01);

(Continued)

(58) Field of Classification Search
CPC ..... E21B 44/005; E21B 44/00; E21B 21/08; E21B 41/0092; E21B 44/02; E21B 47/065

(Continued)

(56) References Cited

U.S. PATENT DOCUMENTS 7,526,385 B2 * 4/2009 Sayers ..... G01V 1/50 702/13
8,527,249 B2 * 9/2013 Jamison ..... E21B 44/02 703/10

(Continued)

FOREIGN PATENT DOCUMENTS

WO 2014066981 A1 5/2014

OTHER PUBLICATIONS

International search report of international search authority (USPTO) for PCT/US17/57451 dated Jan. 3, 2018.

(Continued)

*Primary Examiner* — Juan C Ochoa
(74) *Attorney, Agent, or Firm* — Basil M. Angelo; Angelo IP

(57) ABSTRACT

A system for automated model-based drilling includes a plurality of surface-based sensors configured to sense one or more rig parameters in real-time, a hydraulic modeler unit configured to generate a real-time model of an equivalent circulating density based on one or more rig parameters, a control module configured to continually determine whether the equivalent circulating density is within pre-determined safety margins of a safe pressure window, and a forward parameters simulator configured to, while the equivalent circulating density is within the pre-determined safety margins of the safe pressure window, determine an optimal drilling parameter to change and an optimal drilling parameter amount of change. The control module changes a rig setting corresponding to the optimal drilling parameter to change to the optimal drilling parameter value automatically or outputs the optimal drilling parameter to change and the optimal drilling parameter value to a display for manual adjustment by a driller.

17 Claims, 7 Drawing Sheets

Related U.S. Application Data

(60) Provisional application No. 62/431,059, filed on Dec. 7, 2016.

(51) Int. Cl.
*E21B 44/02* (2006.01)
*E21B 41/00* (2006.01)
*E21B 47/07* (2012.01)

(52) U.S. Cl.
CPC ..... *E21B 44/00* (2013.01); *E21B 44/02* (2013.01); *E21B 47/07* (2020.05); *E21B 41/00* (2013.01)

(58) Field of Classification Search
USPC ..... 703/10, 2
See application file for complete search history.

(56) References Cited

U.S. PATENT DOCUMENTS

| | | | | |
|---|---|---|---|---|
| 10,113,408 | B2 * | 10/2018 | Pobedinski | E21B 44/00 |
| 2001/0042642 | A1 * | 11/2001 | King | E21B 12/02 175/40 |
| 2011/0153296 | A1 | 6/2011 | Sadlier et al. | |
| 2011/0203845 | A1 | 8/2011 | Jamison et al. | |
| 2014/0365409 | A1 | 12/2014 | Burch et al. | |
| 2015/0227841 | A1 * | 8/2015 | Laing | G01V 13/00 706/19 |
| 2016/0245048 | A1 * | 8/2016 | Jamison | E21B 44/04 |
| 2018/0238164 | A1 * | 8/2018 | Jamison | G06N 3/063 |

OTHER PUBLICATIONS

Written opinion of international search authority (USPTO) for PCT/US17/57451 dated Jan. 3, 2018.

* cited by examiner

300

| ACTION | EFFECT |
|---|---|
| As RPM increases | ECD increases |
| As RPM decreases | ECD decreases |
| As flow rate increases | ECD increases |
| As flow rate decreases | ECD decreases |
| While tripping in | ECD increases |
| While tripping out | ECD decreases |
| While reaming in | ECD increases |
| While reaming out | ECD decreases |
| While washing down | ECD increases |
| While pumping out | ECD decreases |

FIG. 3

400

| OPERATIONS | SIGNIFICANT PARAMETERS |
|---|---|
| Tripping | Block position & block speed (bit depth) (flow rate and RPM constant and zero) |
| Drilling | Block position, block speed (bit depth), flow rate, and RPM are controlled and may vary |
| Reaming | Block position, flow rate, and RPM are controlled and may vary |
| Washing down | Block position, block speed, and flow rate are controlled and may vary |
| Circulating | Flow rate is controlled and may vary |
| Sliding | Block position, block speed, and flow rate are controlled and may vary |
| Pumping out | Block position, block speed, and flow rate are controlled and may vary |

FIG. 4

AUTOMATED MODEL BASED DRILLING

CROSS-REFERENCE TO RELATED APPLICATIONS

This application is a continuation of PCT International Application PCT/US2017/057451, filed on Oct. 19, 2017, which claims the benefit of, or priority to, U.S. Provisional Patent Application Ser. No. 62/431,059, filed on Dec. 7, 2016, all of which are hereby incorporated by reference in their entirety.

BACKGROUND OF THE INVENTION

During conventional drilling operations, a drilling fluid, sometimes referred to as mud, is circulated through a fluid circulation system located at or near the surface of the well. The drilling fluid is pumped through the interior passage of a drill string, through a drill bit, and back to the surface through the annulus between the wellbore and the drill pipe. The primary function of the drilling fluid is to maintain pressure inside the wellbore to prevent kicks and wellbore collapse. Additional functions of the drilling fluid include transporting the cuttings to the surface and cooling the drill bit.

To maintain well control, the hydrostatic pressure of the drilling fluid is maintained at an appropriate level for the type of operation being conducted. Typically, the wellbore pressure is maintained within a safe pressure window bounded on a first side by either a pore pressure or a collapse pressure and on a second side by a fracture pressure. If the pore pressure is higher than the collapse pressure, the pore pressure is used as the lower boundary of pressure at a given depth of the safe pressure window. The pore pressure refers to the pressure under which formation fluids may enter into the wellbore with what is called a kick. To maintain well control, the wellbore pressure is kept higher than the pore pressure to prevent undesirable fluid influxes into the wellbore. Weighting agents may be added to the drilling fluid to increase the fluid density and ensure that the hydrostatic pressure remains higher than the pore pressure. If the collapse pressure is higher than the pore pressure, the collapse pressure is used as the lower boundary of pressure at a given depth of the safe pressure window. The collapse pressure refers to the pressure under which the wellbore walls fall in on themselves. To maintain the well under good operational conditions at all times, the wellbore pressure is kept higher than the collapse pressure to prevent undesirable wellbore collapse. On the other side of the spectrum, the fracture pressure is used as the upper boundary of pressure at a given depth of the safe pressure window. The fracture pressure refers to the pressure above which the formation fractures and drilling fluids may be lost into the formation. To maintain well control, the wellbore pressure is kept lower than the fracture pressure to prevent mud loss.

As such, the safe pressure window is bounded by either the pore pressure or collapse pressure on a first side and the fracture pressure on a second side. The pressure inside the wellbore should be maintained within this safe pressure window during all times to prevent undesirable events such as kicks, wellbore collapse, and mud loss.

BRIEF SUMMARY OF THE INVENTION

According to one aspect of one or more embodiments of the present invention, a system for automated model-based drilling includes a plurality of surface-based sensors configured to sense one or more rig parameters in real-time, a hydraulic modeler unit configured to generate a real-time model of an equivalent circulating density based on one or more rig parameters, a control module configured to continually determine whether the equivalent circulating density is within pre-determined safety margins of a safe pressure window, and a forward parameters simulator configured to, while the equivalent circulating density is within the pre-determined safety margins of the safe pressure window, determine an optimal drilling parameter to change and an optimal drilling parameter amount of change. The control module changes a rig setting corresponding to the optimal drilling parameter to change to the optimal drilling parameter value automatically or outputs the optimal drilling parameter to change and the optimal drilling parameter value to a display for manual adjustment by a driller.

According to one aspect of one or more embodiments of the present invention, a method of automated model-based drilling includes identifying a safe pressure window, identifying pre-determined safety margins within the safe pressure window, determining an equivalent circulating density in real-time from a hydraulic model, continuously determining whether the equivalent circulating density is within the safety margins of the safe pressure window, and if the equivalent circulating density is within the safety margins, determining an optimal drilling parameter to change and an optimal drilling parameter value.

Other aspects of the present invention will be apparent from the following description and claims.

BRIEF DESCRIPTION OF THE DRAWINGS

FIG. 3 shows a table of actions and their effect on equivalent circulating density in accordance with one or more embodiments of the present invention.

FIG. 4 shows a table of operations and the significant drilling parameters affecting equivalent circulating density in accordance with one or more embodiments of the present invention.

DETAILED DESCRIPTION OF THE INVENTION

Figure 1:
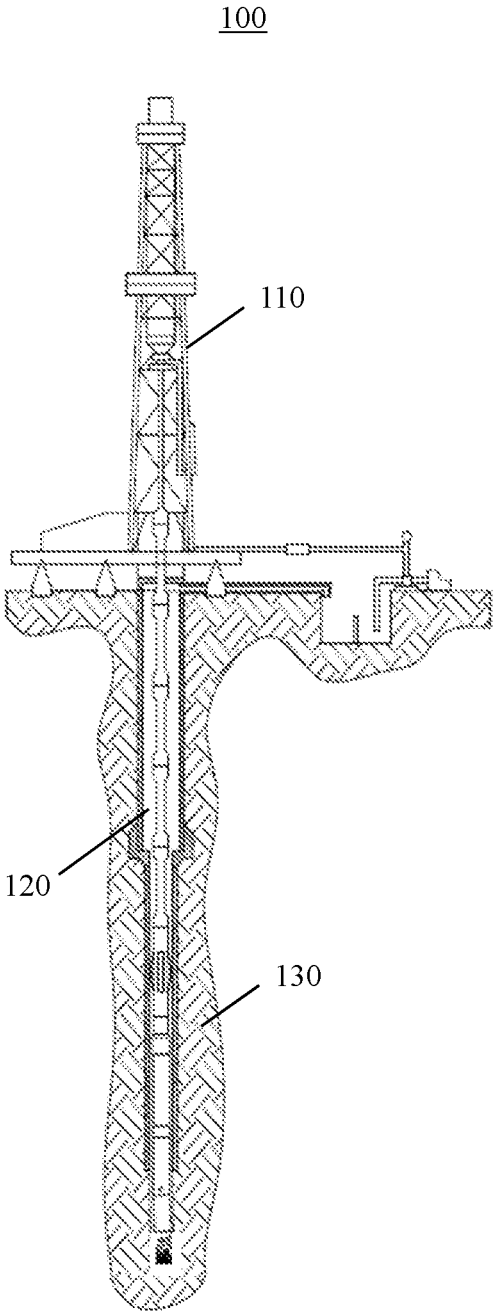
FIG. 1 PRIOR ART
FIG. 1 shows a cross-sectional view of a conventional drilling operation.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are not described to avoid obscuring the description of the present invention.

Conventional drilling operations are manually controlled by a driller who is responsible for operating various equipment on a rig including, but not limited to, one or more mud pumps, the top drive or rotary table, and the drawworks. The driller sets various drilling parameters, including, but not limited to, the flow rate of mud that the mud pumps deliver downhole, the rotation rate of the top drive/rotary table that rotate the drill string, and the position and speed of the block during tripping, drilling, stripping, and other well construction operations. Typically, the driller will attempt to follow a predetermined well program or the instructions of the operator representative on the rig. The values of the drilling parameters that the driller sets are typically based on experience and, sometimes, simulations performed before drilling starts. However, the simulations may be based on one or more assumptions that may or may not be correct.

A number of sources of error are possible when constructing a well under manual control by a driller. Any one or more of human error, simulation error, or bad assumptions may result in the use of incorrect drilling parameters that have disastrous consequences for the well construction process, either from a safety or operational point of view. Even if the drilling parameters are set to best estimates of ideal values, conventional drilling operations conducted today do not take into account, in real-time, the current wellbore pressure and the expected, or confirmed, safe pressure window established by the pore pressure or collapse pressure and the fracture pressure at various depths. As such, the driller will typically operate various equipment based on drilling parameters that are not ideal, and in some instances, that are simply wrong, which can cause the pressure inside the wellbore to either fall below the pore pressure or collapse pressure or rise above the fracture pressure, inducing kicks, wellbore collapse, or mud loss. These undesirable events increase the overall risk to drilling the well and cause significant losses in unproductive downtime, production delay, equipment costs, labor costs, and safety and reclamation expense. In order to prevent these problems, the operations conducted today are usually extremely cautious, with the parameters employed being very conservative. This practice leads to inefficiency and, therefore, significant waste of money.

Accordingly, in one or more embodiments of the present invention, a system and method of automated model-based drilling uses a real-time model of the current wellbore pressure (or equivalent circulating density) and automatically sets the drilling parameters to values that maintain the wellbore pressure within the safe pressure window in a manner that allows drilling operations to be conducted as quickly and efficiently as possible. The real-time model may calculate the wellbore pressure (or equivalent circulating density) for the entire wellbore, from top to bottom, taking into account information about the wellbore including, but not limited to, one or more of well depth, casing depth, internal diameters, inclination angles, water depth, riser diameter, drill string configuration, geothermal gradients, hydrothermal gradients, and real-time drilling parameters such as flow rate, rotation rate, block positon (also referred to as bit depth), block speed, and mud properties. One of ordinary skill in the art will recognize that real-time, as used in this specification, means near real-time due to latency in sensor operation, latency in data transfer and reception, and latency in processing of data. In this context, the combined latencies incurred are on the order of magnitude of mere seconds as opposed to a minute or more and are substantially real-time for operations of the rig.

An optimal sequence of changes to drilling parameters and optimal drilling parameter values may be determined and then applied to the rig. The real-time model may continuously recalculate the wellbore pressure and the process repeats until the wellbore pressure is maintained within the safe pressure window and as close as possible to a pre-determined safety margin of either the pore, collapse, or fracture pressure, depending on the type of operation being conducted. For example, if the operation to be conducted will cause a reduction in the wellbore pressure, such as, for example, tripping out, the pressure inside the wellbore may be maintained at a pressure that is as close as possible to the lower boundary of the safe pressure window plus safety margin, thereby allowing the tripping out to proceed as quickly and efficiently as possible, but, at the same time, as safely as possible. Alternatively, if the operation to be conducted will cause an increase in the wellbore pressure, such as, for example, tripping in, the pressure inside the wellbore may be maintained at a pressure that is as close as possible to the upper boundary of the safe pressure window less safety margin, thereby allowing the tripping in to proceed as quickly and efficiently as possible. Advantageously, the system and the method of automated model-based drilling allow for the model-based automation of drilling operations, taking into account the limits imposed by the rig-specific equipment and formation pressures, without inducing undesirable events such as kicks, wellbore collapse, and mud losses.

FIG. 1 shows a cross-sectional view of a conventional drilling operation 100. A drilling rig 110 may be used to perform a number of functions including, but not limited to, drilling operations, completion operations, production operations, and abandonment operations. During drilling operations, drilling rig 110 may be used to drill a wellbore 120 according to a well program to recover targeted oil or gas reserves (not independently illustrated) disposed below the Earth's surface 130. While the figure depicts a type of land-based drilling rig, other types of land-based rigs, as well as water-based rigs, may be used in accordance with one or more embodiments of the present invention. One of ordinary skill in the art will recognize that drilling rigs, both land-based and water-based, are well known in the art.

Figure 2:
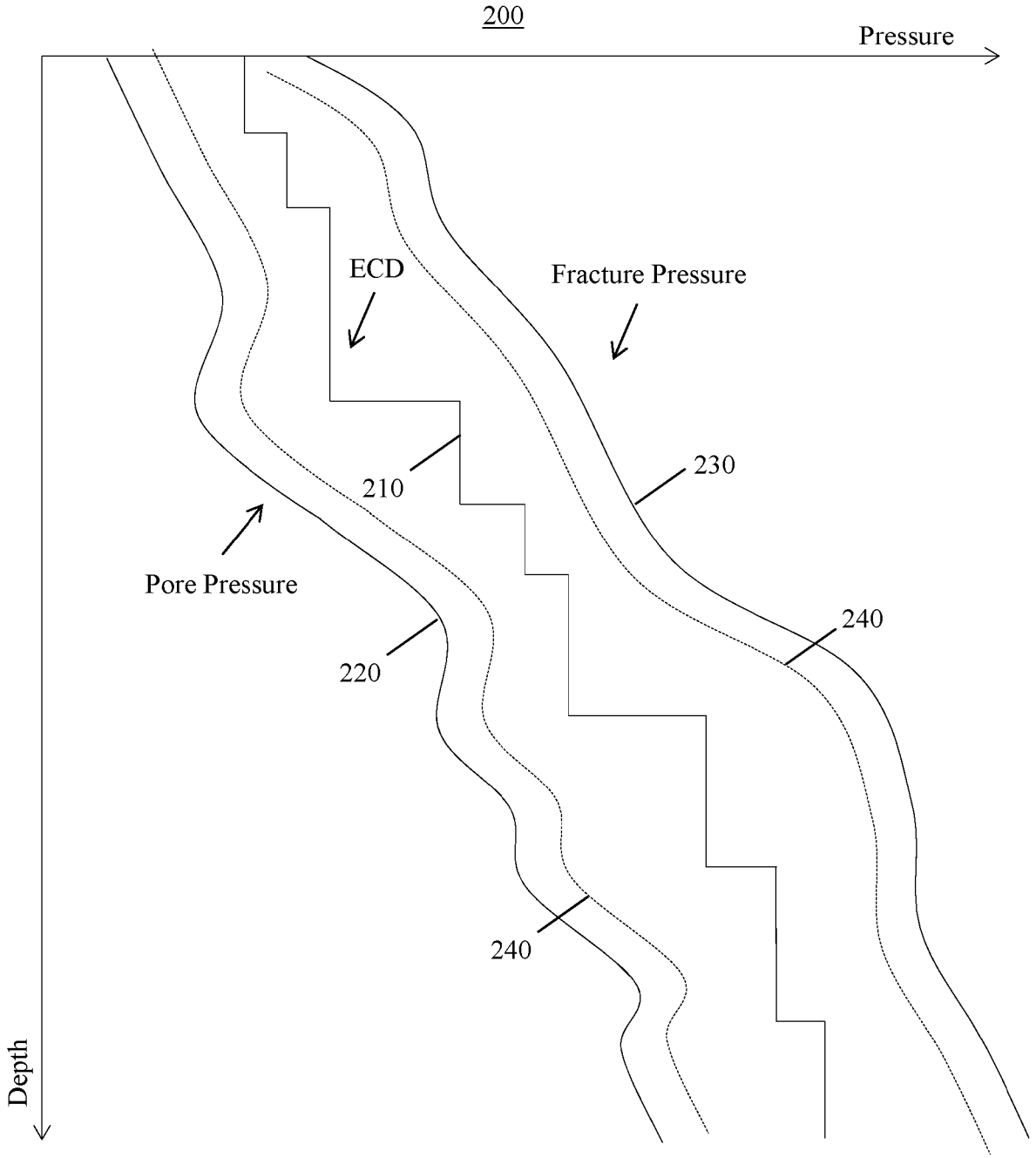
FIG. 2 shows a safe pressure window in accordance with one or more embodiments of the present invention.

FIG. 2 shows a safe pressure window 200 in accordance with one or more embodiments of the present invention. During drilling operations, it is critical to maintain well control. Well control refers to the process of adjusting and maintaining the wellbore pressure (or equivalent circulating density 210) during drilling operations to prevent the influx of formation fluids into the wellbore, wellbore collapse, or fracture the formation itself. Safe pressure window 200 is the pressure window gradient bounded by the pore pressure 220 or the collapse pressure (not independently illustrated) on a first side and the fracture pressure 230 on a second side, along the depth of the wellbore. Typically, a safe pressure window 200 for a given wellbore is provided by the operator based on their geological analysis and models. As shown in the figure, safe pressure window 200 may vary with wellbore depth. In some cases, as previously discussed, the collapse pressure (not independently illustrated) may be higher than the pore pressure. In such cases, safe pressure window 200 may be limited by the collapse pressure (not independently illustrated) on the first side and fracture pressure 230 on the second side.

Pore pressure 220 refers to the pressure of the subsurface formation at a given depth for a given wellbore. This pressure may be affected by the weight of the rock layers above the formation, which may exert a pressure on both pore fluids and particulate matter such as rock or grain. If the wellbore pressure (or equivalent circulating density 210) falls below pore pressure 220, formation fluids may flow into the wellbore and well control may be lost. The collapse pressure (not independently illustrated) refers to the pressure at which the wellbore walls fall in on themselves resulting in wellbore collapse and is sometimes higher than pore pressure 220. In such cases, the collapse pressure (not independently illustrated) may be used instead of pore pressure 220 as the boundary on the first side of safe pressure window 200. Fracture pressure 230 refers to the pressure at which the formation hydraulically fractures or cracks. If the wellbore pressure (or equivalent circulating density 210) rises above fracture pressure 230, wellbore fluids may enter the formation and well control may be lost.

Equivalent circulating density ("ECD") 210 refers to effective density that combines the current mud density and annular pressure drop. ECD 210 is in essence the wellbore pressure expressed in terms of mud weight equivalent. For drilling operations, ECD 210 is typically used instead of wellbore pressure, but one of ordinary skill in the art will recognize that they are alternative representations of the same concept and may be used interchangeably. ECD 210 may be affected by various factors including, but not limited to, wellbore geometry, fluid resistance to flow, pressure of flow, fluid density, fluid temperature, and solids content.

In one or more embodiments of the present invention, a hydraulic model (not shown) may calculate wellbore pressure (or ECD) in real-time based on information about the wellbore including, but not limited to, one or more of well depth, casing depth, internal diameter, inclination angles, water depth, riser diameter, drill string configuration, geothermal gradient, hydrothermal gradient, and real-time drilling parameters such as flow rate, rotation rate, block positon (bit depth), block speed, and mud properties. Some of the real-time drilling parameters may be obtained from surface (rig-based) or downhole sensors that provide actual measurements of the parameters in real-time. The hydraulic model of the wellbore pressure may be used to accurately determine the ECD 210 at various depths in real-time based on real-time data reflecting the state of the wellbore. As shown in the figure, in one or more embodiments of the present invention, drilling parameters may be adjusted to ensure that ECD 210 stays within safe pressure window 200 bounded by pore pressure 220 or collapse pressure (not independently illustrated) and fracture pressure 230 and within a user or operation defined safety margin 240. The user or operation defined safety margin 240 may be predetermined by an operator and is typically based on the operator's tolerance for risk. For example, user or operation defined safety margin 240 may be expressed as a percentage deviation, or offset, from a given boundary of safe pressure window 200, but within safe pressure window 200 itself.

FIG. 3 shows a table 300 of actions and their effect on equivalent circulating density (e.g., 210 of FIG. 2) in accordance with one or more embodiments of the present invention. Various actions taken during drilling operations affect the ECD. As the rotation rate of the drill string increases, the ECD increases. As the rotation rate decreases, the ECD decreases. As the flow rate increases, the ECD increases. As the flow rate decreases, the ECD decreases. When tripping in, reaming in, or washing down, the ECD increases. When tripping out, reaming out, or pumping out, the ECD decreases. In one or more embodiments of the present invention, this information may be used in conjunction with the hydraulic model and other information to optimize the drilling parameters to maintain the ECD within the safe pressure window and a user or operation defined safety margin so that a given operation may be performed more efficiently and safely.

FIG. 4 shows a table 400 of operations and the significant drilling parameters affecting equivalent circulating density (e.g., 210 of FIG. 2) in accordance with one or more embodiments of the present invention.

When tripping in or out, the only drilling parameters of interest are the block position and the block speed. The flow rate and rotation rate of the drill string are held constant and zero. The ECD may be controlled during this operation by adjusting one or more of the block position and the block speed.

When drilling, the significant drilling parameters are the block position, block speed, flow rate, and rotation rate of the drill string, each of which may be controlled and vary. The ECD may be controlled during this operation by adjusting one or more of the block position, block speed, flow rate, and rotation rate of the drill string.

When reaming, the significant drilling parameters are the block position, flow rate, and rotation rate of the drill string, each of which may be controlled and vary. The ECD may be controlled during this operation by adjusting one or more of the block positon, flow rate, and rotation rate of the drill string.

When washing down, the significant drilling parameters are the block position, block speed, and the flow rate, each of which may be controlled and vary. The ECD may be controlled during this operation by adjusting one or more of the block position, block speed, and the flow rate.

When circulating, the significant drilling parameter is the flow rate, which may be controlled and vary. The ECD may be controlled during this operation by adjusting the flow rate.

When sliding, the significant drilling parameters are the block position, block speed, and the flow rate, each of which may be controlled and vary. The ECD may be controlled during this operation by adjusting one or more of the block position, block speed, and the flow rate.

When pumping out, the significant drilling parameters are block position, block speed, and flow rate, each of which may be controlled and vary. The ECD may be controlled during this operation by adjusting one or more of the block position, block speed, and the flow rate.

Figure 5:
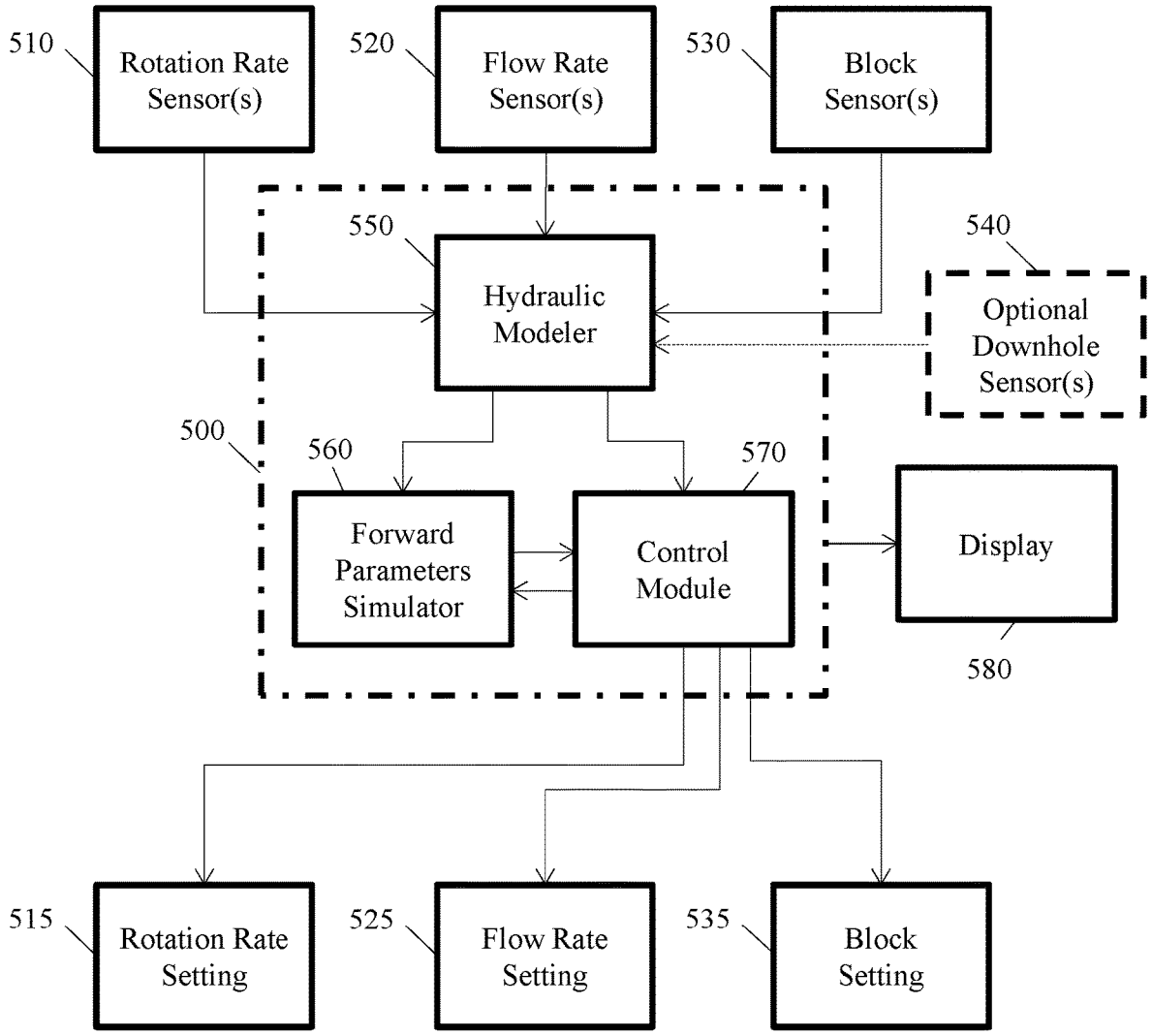
FIG. 5 shows a system for automated model-based drilling in accordance with one or more embodiments of the present invention.

FIG. 5 shows an automated model-based drilling system 500 in accordance with one or more embodiments of the present invention. A drilling rig (not independently illustrated) may include a plurality of surface-based sensors that are configured to sense one or more of rotation rate, flow rate, block position, and block speed in real-time. For example, surface-based sensors may include one or more rotation rate sensors 510 that may be configured to sense the rotation rate of the top drive/rotary table that rotates the drill string, one or more flow rate sensors 520 that may be configured to sense the flow rate of mud that the mud pumps deliver downhole, and one or more block sensors 530 that may be configured to sense the position and/or speed of the block. In certain embodiments, one or more optional downhole sensors 540 may also be used. The one or more downhole sensors 540 may be configured to sense one or more of downhole pressure, flow rate, temperature, and mud density. The one or more surface-based sensors 510, 520, and 530 and the one or more optional downhole sensors 540 provide their respective data as input to automated model-based drilling system 500. In one or more embodiments of the present invention, automated model-based drilling system 500 may include a hydraulic modeler 550, a forward parameters simulator 560, and a control module 570.

Hydraulic modeler 550 may continuously generate a real-time model of the wellbore pressure, or ECD, for a given wellbore based on data including, but not limited to, water depth, well depth, casing diameter, internal diameter, inclination angle, riser diameter, drill string configuration, geothermal gradient, hydrothermal gradient, data provided by one or more surface-based sensors including, but not limited to, sensed rotation rate 510, sensed flow rate 520, and sensed block position or speed 530, and data provided by one or more optional downhole sensors 540 including, but not limited to, downhole sensed flow rate, downhole sensed temperature, and downhole sensed mud density. Using one or more of the data, hydraulic modeler 550 may calculate and output wellbore pressure, or ECD, for a given wellbore in real-time. One of ordinary skill in the art will recognize that hydraulic modeler 550 may be instantiated in software that is configured to be executed on a standard computer or as part of a customized system such as, for example, an embedded system or an industrial system. In addition, one of ordinary skill in the art will recognize that hydraulic modeling, which generates a model of wellbore pressure or equivalent circulating density, is well known in the art.

Forward parameters simulator 560 may input the modeled ECD provided by hydraulic modeler 550 and the current position of the modeled ECD with respect to the safe pressure window provided by control module 570 and wellbore constraints including, but not limited to, the pore and collapse pressures at a lower end and the fracture pressure at the upper end, including the safety margin pre-defined by the user, minimum and maximum values for each drilling parameter capable of being changed as well as the step size of value changes that are possible for each drilling parameter. While the ECD is within the pre-determined safety margins of the safe pressure window, forward parameters simulator 560 may determine an optimal sequence of drilling parameters to change (or input a user preference for a sequence of drilling parameters to change) and determine the optimal drilling parameter values for each parameter change in the sequence of changes. Another set of limitations may be provided by each piece of equipment, which must be operated within its own operational envelope.

In certain instances, where the pore pressure is higher than the collapse pressure, the pre-determined safety margins may include on a first side a percentage offset from the pore pressure within the safe pressure window and on a second side a percentage offset from the fracture pressure within the safe pressure window. In other instances, where the collapse pressure is higher than the pore pressure, the pre-determined safety margins may include on a first side a percentage offset from the collapse pressure within the safe pressure window and on a second side a percentage offset from the fracture pressure within the safe pressure window. When a given operation has a tendency to change ECD toward one side or the other of the safe pressure window, optimization selects the appropriate safety margin on that appropriate side as the boundary for optimization.

Most operations require a change to more than one drilling parameter in sequential order. For example, drilling operations may require the lowering of the bit (block position parameter), turning on the mud pumps (flow rate parameter), and starting to rotate the drill string (rotation rate parameter). The operator or driller may have a preference for how to sequence these drilling parameter changes, such as, for example, turning on the mud pumps first (flow rate parameter), then lowering the bit (block position parameter), and then starting to rotate the drill pipe (rotation rate parameter). Others may have a different preference for how to sequence these drilling parameter changes. In such a case, the operator or driller may input this preference into automated model-based drilling system 500 (i.e., via control module 570), which will then attempt to optimize within the constraints provided. Alternatively, automated model-based drilling system 500 (i.e., via control module 570), may determine the optimal sequence of drilling parameters to change and the optimal drilling parameter values automatically. Because drilling has a tendency to increase ECD, the safety margin offset from the fracture pressure may be used as the boundary for optimization.

In certain embodiments, where there is a user preference for a sequence of drilling parameters to change for a given operation, simulator 560 may, for each drilling parameter to vary in the user specified sequence, enumerate all combinations of drilling parameter value changes and their simulated ECDs to determine the optimal drilling parameter value. All combinations may be enumerated by starting with the first drilling parameter to vary, hold all other drilling parameters to their current values, and then determining a simulated ECD for each possible value of the drilling parameter to vary. The enumerated list may then be sorted according to the largest change in simulated ECD toward, but less than, the appropriate safety margin of the safe pressure window, which may then be selected as the optimal drilling parameter value for the selected drilling parameter to vary. This process may then be repeated for each drilling parameter to vary in the user specified sequence. Each iteration of the process may use the last iteration result as the starting condition for drilling parameter values for that iteration. In this way, the operator or driller may specify the sequence of drilling parameters to change, but simulator 560 determines the optimal drilling parameter value for each change in the sequence.

In other embodiments, where forward parameters simulator 560 determines an optimal sequence for changing drilling parameters, simulator 560 may enumerate all permutations of sequential changes in drilling parameters, all combinations of drilling parameter value changes for each permutation, and their simulated ECDs to determine the optimal sequence of drilling parameters to change and the optimal sequence of drilling parameter values.

In certain embodiments, an enumerated list may be generated by selecting a first drilling parameter to vary, holding all other drilling parameter values constant, and then determining a simulated ECD for each possible parameter value for the selected drilling parameter to vary. This process is repeated for each drilling parameter capable of varying. The enumerated list may then be sorted according to the largest change in simulated ECD toward, but less than, the appropriate safety margin of the safe pressure window, which may then be selected as the first optimal drilling parameter to change and the first optimal drilling parameter value. If there is more than one drilling parameter to change, this process repeats in the same manner, except, the previous iterations optimal drilling parameter is held constant at its optimal drilling parameter value, a different drilling parameter is selected to vary, and all other drilling parameter values, if any, are held constant. The simulated ECD for each possible parameter value for the selected drilling parameter to vary may be determined. The enumerated list may then be sorted according to the largest change in simulated ECD toward, but less than, the appropriate safety margin of the safe pressure window, which may then be selected as the next optimal drilling parameter to change and the next optimal drilling parameter value. This process is repeated for as many drilling parameters as there are to sequence for a given operation. In this way, simulator 560 determines an optimal permutation, or sequence, of drilling parameters to change and optimal drilling parameter values for those changes.

In other embodiments, an enumerated list may be generated by determining all permutations of drilling parameters sequences and, for each sequence, all combinations of drilling parameter values for each sequence, to determine the largest net movement in ECD toward, but less than, the appropriate safety margin of the safe pressure window. For example, if an operation includes three drilling parameters to change, there are six potential permutations, or sequences, of drilling parameters to change. For each sequence, all combinations of drilling parameter values for each drilling parameter to change and the resulting simulated ECD for each, may be determined. Upon completion, the enumerated list includes all potential permutations or sequences of drilling parameters to change, all potential combinations of drilling parameter values for each sequence, and the net ECD for each. The enumerated list may then be sorted according to the largest change in simulated ECD toward, but less than, the appropriate safety margin of the safe pressure window, which may then establish the optimal sequence of drilling parameters to change and the optimal drilling parameter values.

Control module 570, in addition to evaluating the position of the modeled ECD with respect to the safe pressure window, receives as input from forward parameters simulator 560 an optimal sequence of drilling parameters to change (or a user preference for a sequence of drilling parameters to change) and optimal drilling parameter values that are then used to change the actual drilling parameters of the rig 515, 525, and/or 535 or output the suggested change to a display 580 for manual adjustment by the driller. In certain embodiments, control module 570 may change the appropriate rig setting, such as, for example, rotation rate setting 515, flow rate setting 525, or block setting 535, in sequence according to the optimal or user specified sequence to change the drilling parameters 515, 525, and/or 535 to their optimal values automatically. In other embodiments, control module 570 may output the optimal sequence of drilling parameters to change (or a user preference for a sequence of drilling parameters to change) and optimal drilling parameter values to a display 580 for manual adjustment by a driller. In one or more embodiments of the present invention, control module 570 may be instantiated in software that is configured to be executed on a standard computer or as part of a customized system such as, for example, an embedded system or an industrial system. One of ordinary skill in the art will recognize that hydraulic modeler 550, forward parameters simulator 560, and control module 570 may be implemented as part of the same system or discrete systems that work cooperatively as a computing system to achieve the desired result.

Figure 6:
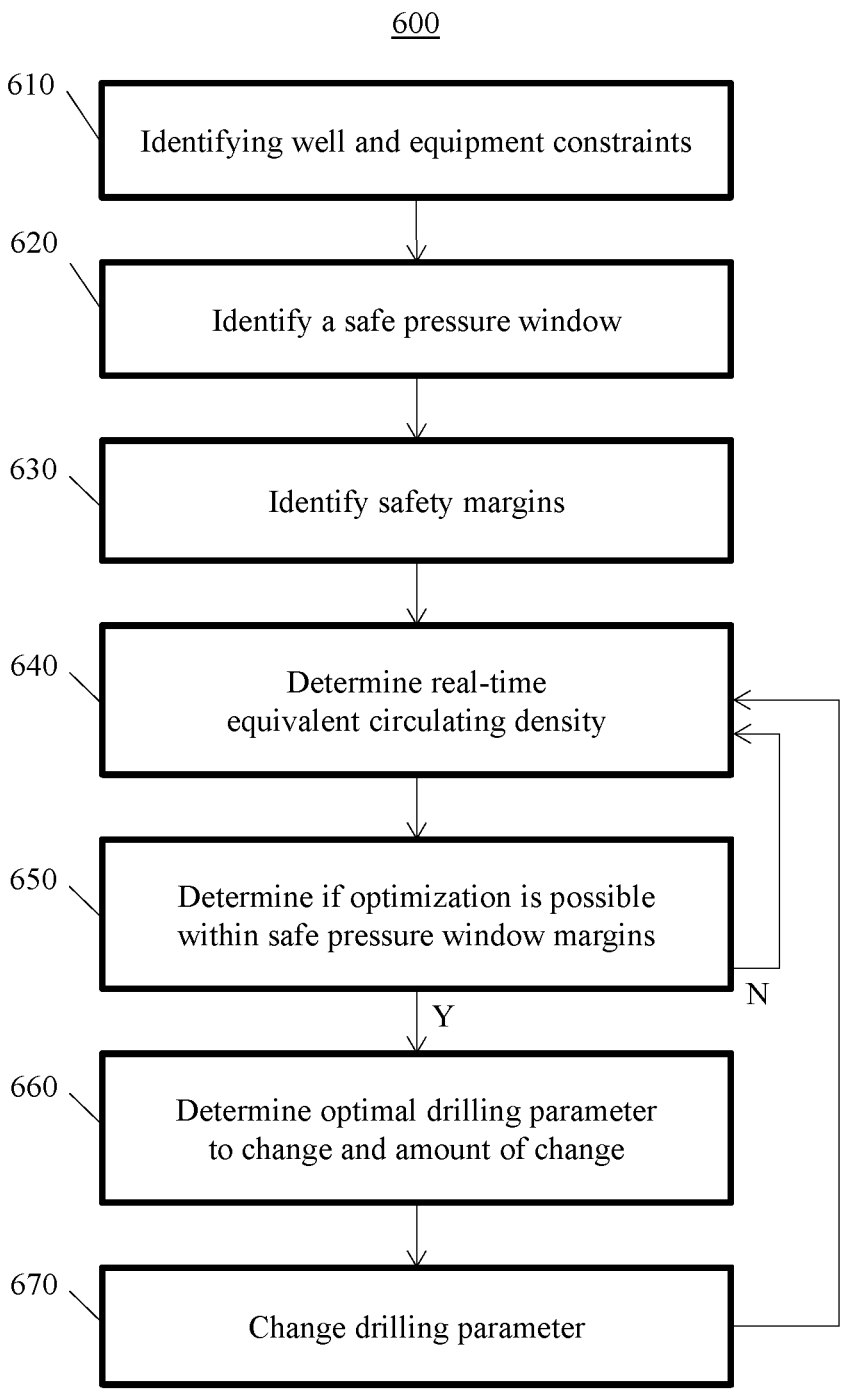
FIG. 6 shows a method of automated model-based drilling in accordance with one or more embodiments of the present invention.

FIG. 6 shows a method of automated model-based drilling 600 in accordance with one or more embodiments of the present invention. A method of automated model-based drilling 600 includes, in step 610, identifying wellbore and equipment constraints. The wellbore constraints may include, but are not limited to, the pore and collapse pressure at a lower end and the fracture pressure at the upper end, including the safety margin pre-defined by the user, minimum and maximum values for each drilling parameter capable of being changed as well as the step size of value changes that are possible for each drilling parameter. Some or all of the wellbore constraints may be provided as input to the automated model-based drilling system (500 of FIG. 5, via control module 570), whereas some may be provided by a hydraulic modeler (e.g., hydraulic modeler 550 of FIG. 5) or a forwards parameter similar (e.g., forward parameters simulator 560 of FIG. 5).

In step 620, a safe pressure window may be identified. The safe pressure window is typically provided, as input to, for example, automated model-based drilling system (500 of FIG. 5, via control module 570), by the operator based on their geological analysis and models, but may be determined by a forward parameters simulator (560 of FIG. 5) or a control module (570 of FIG. 5). In instances where the pore pressure is higher than the collapse pressure, the safe pressure window may be a pressure gradient established by the pore pressure as a lower boundary of pressure and the fracture pressure as an upper boundary of pressure, along the depth of the wellbore. In instances where the collapse pressure is higher than the pore pressure, the safe pressure window may be a pressure gradient established by the collapse pressure as a lower boundary of pressure and the fracture pressure as an upper boundary of pressure, along the depth of the wellbore. The safe pressure window may be provided as input to automated model-based drilling system (500 of FIG. 5) or determined by a forward parameters simulator (560 of FIG. 5) or a control module (570 of FIG. 5).

In step 630, a safety margin may be identified. The user or operation-defined safety margin may be predetermined by an operator and is typically based on the operator's tolerance for risk. The safety margin may be expressed as a percentage deviation, or offset, from a given boundary of the safe pressure window. For example, a safety margin for a lower boundary may be a percentage offset from the pore pressure or collapse pressure that is within the safe pressure window. Similarly, a safety margin for an upper boundary may be a percentage offset from the fracture pressure that is within the safe pressure window. The safety margins may be provided as input to automated model-based drilling system (500 of FIG. 5). For purposes of optimization, the safety margins may be treated as the boundaries of the safe pressure window. In one or more embodiments of the present invention, a control module (570 of FIG. 5) may recommend a safety margin for user adoption.

In step 640, an ECD may be determined in real-time from a hydraulic model. A hydraulic modeler (550 of FIG. 5) may generate a real-time model of the ECD based on data including, but not limited to, water depth, well depth, casing diameter, internal diameter, inclination angle, riser diameter, drill string configuration, geothermal gradient, hydrothermal gradient, data provided by one or more surface-based sensors including, but not limited to, sensed rotation rate (510 of FIG. 5), sensed flow rate (520 of FIG. 5), and sensed block position and/or block speed (530 of FIG. 5), and data provided by one or more optional downhole sensors (540 of FIG. 5) including, but not limited to, downhole sensed flow rate, downhole sensed temperature, and downhole sensed mud density. Using one or more of the data, the hydraulic modeler (550 of FIG. 5) of the automated model-based drilling system (500 of FIG. 5) may calculate and output the ECD in real-time on a continuous basis.

In step 650, a determination of whether optimization within the safety margins of the safe pressure window may be made. A control module (570 of FIG. 5) of the automated model-based drilling system (500 of FIG. 5) may continuously determine a location of the current ECD with respect to the safe pressure window and safety margins. If the current operation being conducted increases wellbore pressure, the determination of whether optimization is possible may be made by determining whether current ECD is less than the safety margin offset from the facture pressure. Similarly, if the current operation being conducted decreases wellbore pressure, the determination of whether optimization is possible may be made by determining whether the current ECD is more than the safety margin offset from the pore or collapse pressure.

In step 660, while the ECD is within the pre-determined safety margins of the safe pressure window, a determination of an optimal sequence of drilling parameters to change (or a user specified preference for a sequence of drilling parameters to change) and optimal drilling parameter values may be made. In certain embodiments, where there is a user preference for a sequence of drilling parameters to change for a given operation, a forward parameters simulator (560 of FIG. 5) may, for each drilling parameter to vary in the user specified sequence, enumerate all combinations of drilling parameter value changes and their simulated ECDs to determine the optimal drilling parameter value. An enumerated list may be generated by starting with the first drilling parameter to vary, hold all other drilling parameters to their current values, and then determining a simulated ECD for each possible value of the drilling parameter to vary. The enumerated list may then be sorted according to the largest change in simulated ECD toward, but less than, the appropriate safety margin of the safe pressure window, which may then be selected as the optimal drilling parameter value for the selected drilling parameter to vary. This process may then be repeated for each drilling parameter to vary in the user specified sequence. Each iteration of the process may use the last iteration result as the starting conditions for drilling parameter values for that iteration. In this way, the operator or driller may specify the sequence of drilling parameters to change, but the forward parameters simulator (560 of FIG. 5) may determine the optimal drilling parameter value for each change in the sequence.

In other embodiments, where the forward parameters simulator (560 of FIG. 5) determines an optimal sequence for changing drilling parameters, the forward parameters simulator (560 of FIG. 5) may enumerate all permutations of sequential changes in drilling parameters, all combinations of drilling parameter value changes for each sequence, and their simulated ECDs to determine the optimal sequence of drilling parameters to change and the optimal sequence of drilling parameter values for the operation being conducted. In certain embodiments, an enumerated list may be generated by selecting a first drilling parameter to vary, holding all other drilling parameter values constant, and then determining a simulated ECD for each possible parameter value for the selected drilling parameter to vary. This process is repeated for each drilling parameter capable of varying. The enumerated list may then be sorted according to the largest change in simulated ECD toward, but less than, the appropriate safety margin of the safe pressure window, which may then be selected as the first optimal drilling parameter to change and the first optimal drilling parameter value. If there is more than one drilling parameter to change, this process repeats in the same manner, except, the previous iterations optimal drilling parameter is held constant at its optimal drilling parameter value, a different drilling parameter is selected to vary, and all other drilling parameter values, if any, are held constant. The simulated ECD for each possible parameter value for the selected drilling parameter to vary may be determined. The enumerated list may then be sorted according to the largest change in simulated ECD toward the appropriate safety margin of the safe pressure window, which may then be selected as the next optimal drilling parameter to change and the next optimal drilling parameter value. This process is repeated for as many drilling parameters as there are to sequence for a given operation. In this way, simulator 560 determines an optimal permutation, or sequence, of drilling parameters to change and optimal drilling parameter values for those changes.

In other embodiments, all combinations may be enumerated by determining all permutations of drilling parameters sequences and, for each sequence, all combinations of drilling parameter values, to determine the largest net movement in ECD toward, but less than, the appropriate safety margin of the safe pressure window. For example, if an operation includes three drilling parameters to change, there are six potential permutations, or sequences, of drilling parameters to change. For each sequence, all combinations of drilling parameter values for each drilling parameter to change and the resulting simulated ECD for each, is determined. Upon completion, the enumerated list includes all potential permutations of sequences of drilling parameters to change, all potential combinations of drilling parameter values for each sequence, and the net ECD for each. The enumerated list may then be sorted according to the largest change in simulated ECD toward, but less than, the appropriate safety margin of the safe pressure window, which may then establish the optimal permutation, or sequence, of drilling parameters to change and the optimal drilling parameter values.

In step 670, a sequence of one or more drilling parameters may changed or output on a display (580 of FIG. 5). In certain embodiments, a control module (570 of FIG. 5) may change the appropriate rig setting, such as, for example, rotation rate setting (515 of FIG. 5), flow rate setting (525 of FIG. 5), or block setting (535 of FIG. 5), corresponding to the optimal sequence of drilling parameters to change and the optimal drilling parameter values automatically. In other embodiments, control module (570 of FIG. 5) may output the optimal sequence of drilling parameters to change and the optimal drilling parameter values to a display (580 of FIG. 5) for manual adjustment by a driller.

In one or more embodiments of the present invention, a non-transitory computer-readable medium, comprising software instructions that, when executed by a processor, may perform method 600 in whole or in part as part of an automated model-based drilling system (500 of FIG. 5).

Figure 7:
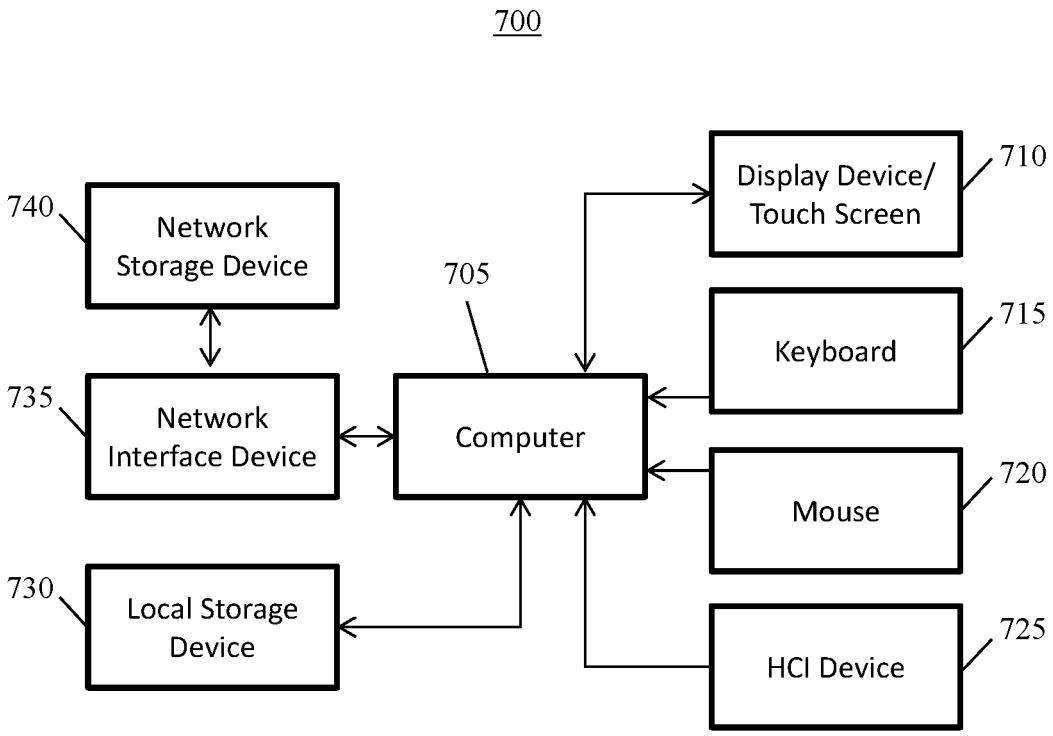
FIG. 7 shows a computing system for an automated model-based drilling system in accordance with one or more embodiments of the present invention.

FIG. 7 shows a computing system 700 for an automated model-based drilling system 500 in accordance with one or more embodiments of the present invention. Automated model-based drilling system 500 may use one or more computing systems 700. Additionally, various aspects of automated model-based drilling system 500 may be distributed among the one or more computing systems 700 used. Computing system 700 may include one or more computers 705 that each includes one or more printed circuit boards (not shown) or flex circuits (not shown) on which one or more processors (not shown) and system memory (not shown) may be disposed. Each of the one or more processors (not shown) may be a single-core processor (not shown) or a multi-core processor (not shown). Multi-core processors (not shown) typically include a plurality of processor cores (not shown) disposed on the same physical die or a plurality of processor cores (not shown) disposed on multiple die that are disposed in the same mechanical package. Computing system 700 may include one or more input/output devices such as, for example, a display device 710, keyboard 715, mouse 720, and/or any other human-computer interface device 725. The one or more input/output devices may be integrated into computer 705. Display device 710 may be a touch screen that includes a touch sensor (not shown)

configured to sense touch. A touch screen enables a user to control various aspects of computing system 700 by touch or gestures. For example, a user may interact directly with objects depicted on display device 710 by touch or gestures that are sensed by the touch sensor and treated as input by computer 705.

Computing system 700 may include one or more local storage devices 730. Local storage device 730 may be a solid-state memory device, a solid-state memory device array, a hard disk drive, a hard disk drive array, or any other non-transitory computer readable medium. Local storage device 730 may be integrated into computer 705. Computing system 700 may include one or more network interface devices 740 that provide a network interface to computer 705. The network interface may be Ethernet, Wi-Fi, Bluetooth, WiMAX, Fibre Channel, or any other network interface suitable to facilitate networked communications. Computing system 700 may include one or more network-attached storage devices 740 in addition to, or instead of, one or more local storage devices 730. Network-attached storage device 740 may be a solid-state memory device, a solid-state memory device array, a hard disk drive, a hard disk drive array, or any other non-transitory computer readable medium. Network-attached storage device 750 may not be collocated with computer 705 and may be accessible to computer 705 via one or more network interfaces provided by one or more network interface devices 735. One of ordinary skill in the art will recognize that computer 705 may be a server, a workstation, a desktop, a laptop, a netbook, a tablet, or any other type of computing system in accordance with one or more embodiments of the present invention.

Advantages of one or more embodiments of the present invention may include one or more of the following:

In one or more embodiments of the present invention, a system and method of automated model-based drilling determines an optimal sequence of drilling parameters to change for a given operation (or inputs a user specified preference of the sequence of drilling parameters to change) and determines optimal drilling parameter values such that the ECD is maintained as close to an operation appropriate safety margin of the safe pressure window.

In one or more embodiments of the present invention, a system and method of automated model-based drilling prevents mud losses, kicks, and wellbore collapse.

In one or more embodiments of the present invention, a system and method of automated model-based drilling reduces or eliminates human error in making decisions regarding the appropriate drilling parameters for a particular drilling operation.

In one or more embodiments of the present invention, a system and method of automated model-based drilling reduces or eliminates unproductive downtime.

In one or more embodiments of the present invention, a system and method of automated model-based drilling reduces the amount of time required to perform various drilling operations, thereby increasing productivity, and reducing costs.

In one or more embodiments of the present invention, a system and method of automated model-based drilling maximizes tripping in speed while maintaining wellbore pressure within the safe pressure window and a user or operation defined safety margin.

In one or more embodiments of the present invention, a system and method of automated model-based drilling maximizes tripping out speed while maintaining wellbore pressure within the safe pressure window and a user or operation defined safety margin.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A system for automated model-based drilling comprising:

a plurality of surface-based sensors that sense one or more rig parameters in real-time;

a hydraulic modeler unit that generates a real-time model of an equivalent circulating density based on one or more rig parameters;

a control module that continually determines whether the equivalent circulating density is within pre-determined safety margins of a safe pressure window; and a forward parameters simulator that, while the equivalent circulating density is within the pre-determined safety margins of the safe pressure window:

enumerates all permutations of sequential changes in drilling parameters for a type of operation being conducted where each permutation comprises a sequence of drilling parameters to change, for each permutation enumerates all combinations of drilling parameter values and calculates a simulated equivalent circulating density for each combination of drilling parameter values, and determines an optimal sequence of drilling parameters to change and optimal drilling parameter values based on the combination having the largest change in simulated equivalent circulating density, wherein the control module automatically changes drilling parameters to their optimal drilling parameter values in a sequence corresponding to the optimal sequence of drilling parameters to change.

2. The system of claim 1, wherein the one or more rig parameters include one or more of surface sensed rotation rate, surface sensed flow rate, surface sensed block position, sensed block speed, downhole sensed pressure, downhole sense flow rate, downhole sensed temperature, and downhole sensed mud density.

3. The system of claim 2, wherein the hydraulic modeler generates the real-time model of the equivalent circulating density based on rig parameters including one or more of surface sensed rotation rate, surface sensed flow rate, surface sensed block position, surface sensed block speed, downhole sensed pressure, downhole sense flow rate, downhole sensed temperature, and downhole sensed mud density.

4. The system of claim 1, wherein the hydraulic modeler generates the real-time model of the equivalent circulating density based on parameters including one or more of a water depth, a well depth, a casing diameter, an internal diameter, an inclination, a riser diameter, a drill string configuration, a geothermal gradient, and a hydrothermal gradient.

5. The system of claim 1, wherein the safe pressure window is bounded on a first side by a pore pressure and on a second side by a fracture pressure.

6. The system of claim 5, wherein the pre-determined safety margins include on the first side a percentage offset greater than the pore pressure and on the second side a percentage offset less than the fracture pressure.

7. The system of claim 1, wherein the safe pressure window is bounded on a first side by a collapse pressure and on a second side by a fracture pressure.

8. The system of claim 7, wherein the pre-determined safety margins include on the first side a percentage offset greater than the collapse pressure and on the second side a percentage offset less than the fracture pressure.

9. A method of automated model-based drilling comprising:

identifying a safe pressure window;

identifying pre-determined safety margins within the safe pressure window;

determining an equivalent circulating density in real-time from a hydraulic model;

continuously determining whether the equivalent circulating density is within the pre-determined safety margins of the safe pressure window;

while the equivalent circulating density is within the pre-determined safety margins, enumerating all permutations of sequential changes in drilling parameters for a type of operation being conducted where each permutation comprises a sequence of drilling parameters to change, for each permutation, enumerating all combinations of drilling parameter values and calculating a simulated equivalent circulating density for each combination of drilling parameter values, determining an optimal sequence of drilling parameters to change and optimal drilling parameter values based on the combination having the largest change in simulated equivalent circulating density, and changing drilling parameters to their optimal drilling parameter values in a sequence corresponding to the optimal sequence of drilling parameters to change.

10. The method of claim 9, further comprising:

identifying wellbore constraints.

11. The method of claim 9, wherein the safe pressure window is bounded on a first side by a pore pressure and on a second side by a fracture pressure.

12. The method of claim 11, wherein the pre-determined safety margins include on the first side a percentage offset greater than the pore pressure and on the second side a percentage offset less than the fracture pressure.

13. The method of claim 9, wherein the safe pressure window is bounded on a first side by a collapse pressure and on a second side by a fracture pressure.

14. The method of claim 13, wherein the pre-determined safety margins include on the first side a percentage offset greater than the collapse pressure and on the second side a percentage offset less than the fracture pressure.

15. The method of claim 9, wherein the hydraulic model determines the equivalent circulating density in real-time based on parameters including one or more of surface sensed rotation rate, surface sensed flow rate, surface sensed block position, and surface sensed block speed.

16. The method of claim 9, wherein the hydraulic model determines the equivalent circulating density in real-time based on parameters including one or more of downhole sensed pressure, downhole sense flow rate, downhole sensed temperature, and downhole sensed mud density.

17. The method of claim 9, wherein the hydraulic model determines the equivalent circulating density in real-time based on parameters including one or more of a water depth, a well depth, a casing diameter, an internal diameter, an inclination, a riser diameter, a drill string configuration, a geothermal gradient, and a hydrothermal gradient.

* * * * *